US010359233B2

(12) United States Patent
Liu et al.

(10) Patent No.: US 10,359,233 B2
(45) Date of Patent: Jul. 23, 2019

(54) BLANK WATER BLOWING DEVICE

(71) Applicant: CITIC Dicastal CO., LTD, Qinhuangdao (CN)

(72) Inventors: Weidong Liu, Qinhuangdao (CN); Jiandong Guo, Qinhuangdao (CN); Bowen Xue, Qinhuangdao (CN)

(73) Assignee: CITIC Dicastal CO., LTD, Qinhuangdao (CN)

( * ) Notice: Subject to any disclaimer, the term of this patent is extended or adjusted under 35 U.S.C. 154(b) by 163 days.

(21) Appl. No.: 15/640,692

(22) Filed: Jul. 3, 2017

(65) Prior Publication Data

US 2018/0010851 A1 Jan. 11, 2018

(30) Foreign Application Priority Data

Jul. 8, 2016 (CN) ..... 2016 1 0535517

(51) Int. Cl.

| | |
|---|---|
| ***F26B 11/00*** | (2006.01) |
| ***F26B 21/00*** | (2006.01) |
| ***F26B 25/00*** | (2006.01) |
| ***F26B 5/00*** | (2006.01) |
| ***F26B 11/08*** | (2006.01) |

(52) U.S. Cl.

CPC ..... *F26B 11/00* (2013.01); *F26B 5/00* (2013.01); *F26B 11/08* (2013.01); *F26B 21/004* (2013.01); *F26B 25/003* (2013.01)

(58) Field of Classification Search

CPC .. F26B 11/00; F26B 5/00; F26B 11/08; F26B 21/004; F26B 25/003

USPC ..... 34/236

See application file for complete search history.

(56) References Cited

U.S. PATENT DOCUMENTS

| | | | | |
|---|---|---|---|---|
| 7,966,741 | B2 * | 6/2011 | Gorbell | C05F 3/00 34/60 |
| 8,726,539 | B2 * | 5/2014 | Potter | F26B 9/02 165/54 |
| 9,170,035 | B2 * | 10/2015 | Prud'homme | F26B 9/06 |
| 9,247,725 | B2 * | 2/2016 | Hosli | A01M 1/20 |
| 9,746,239 | B2 * | 8/2017 | Grabolle | F26B 23/10 |
| 9,885,520 | B1 * | 2/2018 | Abbasi | F26B 21/12 |
| 10,182,645 | B2 * | 1/2019 | Xue | A46B 13/02 |
| 10,189,094 | B2 * | 1/2019 | Yang | B23B 39/16 |
| 10,196,087 | B2 * | 2/2019 | Xue | B62D 7/18 |
| 2005/0246942 | A1 * | 11/2005 | Mueller | A01M 1/2094 43/124 |
| 2011/0302802 | A1 * | 12/2011 | Wiseman | D06F 58/203 34/493 |

(Continued)

*Primary Examiner* — Stephen M Gravini

(74) *Attorney, Agent, or Firm* — Maier & Maier, PLLC

(57) ABSTRACT

The present invention provides a blank on-line water blowing device. The blank on-line water blowing device includes a frame, a lift cylinder, bearing seats A, linear bearings, guide shafts, a support, a servomotor, a lifting frame, a speed reducer, a bearing seat B, a bearing, a rotating shaft, a synchronous pulley A, a synchronous belt, a gland, a base, a base plate, a flange, springs, copper sleeves, floating columns, an air supply pipe, air amplifiers and a mounting rack. The blank on-line water blowing device provided by the present invention can meet the requirement of blank water blowing, and meanwhile, has the characteristics of simple structure, convenience in manufacturing, stable performance and capability of meeting the precision machining requirement.

3 Claims, 3 Drawing Sheets

(56) References Cited

U.S. PATENT DOCUMENTS

| | | | | |
|---|---|---|---|---|
| 2012/0080363 | A1* | 4/2012 | Evanovich | B01D 1/14 210/86 |
| 2015/0128483 | A1* | 5/2015 | Krupp | F24H 3/025 43/132.1 |
| 2018/0010851 | A1* | 1/2018 | Liu | F26B 11/00 |

* cited by examiner

BLANK WATER BLOWING DEVICE

TECHNICAL FIELD

The present invention relates to a machining device, and in particular to a device for removing residual water on a blank through high-pressure air.

BACKGROUND ART

In an automobile wheel machining process, a wheel blank after heat treatment needs to be cooled to below 50 degrees centigrade before starting an X-ray inspection working process, and wheel manufacturing enterprises generally utilize a water cooling mode to cool the wheel blank. However, in order to ensure the accuracy of X-ray inspection, residual water on the front surface of the wheel blank needs to be removed. Therefore, the present invention provides a device for removing the residual water on the blank through high-pressure air.

SUMMARY OF THE INVENTION

An object of the present invention is to provide a blank water blowing device.

To achieve the object described above, a technical solution of the present invention is as follows: a blank water blowing device is composed of a frame, a lift cylinder, bearing seats A, linear bearings, guide shafts, a support, a servomotor, a lifting frame, a speed reducer, a bearing seat B, a bearing, a rotating shaft, a synchronous pulley A, a synchronous belt, a gland, a base, a base plate, a flange, springs, copper sleeves, floating columns, an air supply pipe, air amplifiers and a mounting rack. The support and the mounting rack are fixed on the frame, the air amplifiers are mounted on the mounting rack through the air supply pipe, the lift cylinder and the bearing seats A are fixed on the support, the guide shafts are mounted in the bearing seats A through the bearing seats A, the top ends of four guide shafts are fixed on the lifting frame, the servomotor, the speed reducer and the bearing seat B are mounted on the lifting frame, an output shaft of the speed reducer is connected with the synchronous pulley A, the rotating shaft is mounted on the bearing seat B through the bearing and the gland, the synchronous pulley is arranged at the upper end of the rotating shaft, the upper end of the rotating shaft is connected with the synchronous pulley A through the synchronous belt, and the base plate is fixed above the rotating shaft through the base. The springs, the copper sleeves and the floating columns are sealed in the base plate and the flange, the copper sleeves are mounted on the flange, two ends of each spring are respectively connected with the base plate and a plane of a large-diameter lower end of the middle part of the corresponding floating column, and the floating columns can float up and down under the action of an external force and the springs.

Four groups of adjacent floating columns are distributed on the flange in a radiating manner, each group comprises four floating columns distributed in 120 degrees, and the radial pitch diameters of the four groups of corresponding floating columns are arithmetic sequence.

During actual use, a blank is conveyed to a position of the blank water blowing device through conveyor chains; compressed air is supplied; the lift cylinder drives the flange to lift up through the linear bearings and the guide shafts, and the flange comes into contact with a flange face of a wheel; under the action of the gravity of the wheel, the floating columns in contact with the flange face of the wheel descend, and a group of floating columns in contact with the side wall of the flange face clamp the wheel in a descending process in order to prevent the wheel from radially moving, so that high-precision location of the blank is implemented. The servomotor starts working to drive the flange and the wheel to rotate, next, the air supply pipe supplies the compressed air, the compressed air passes through the air amplifiers to form high-pressure air flows, and the high-pressure air flows blow off residual water on the blank. So far, the blank water blowing operation is completed.

The blank water blowing device provided by the present invention can meet the requirement of blank water blowing and also has the characteristics of simple structure, convenience in manufacturing, and stable performances, and capability of meeting the precision machining requirement.

Figure 1:
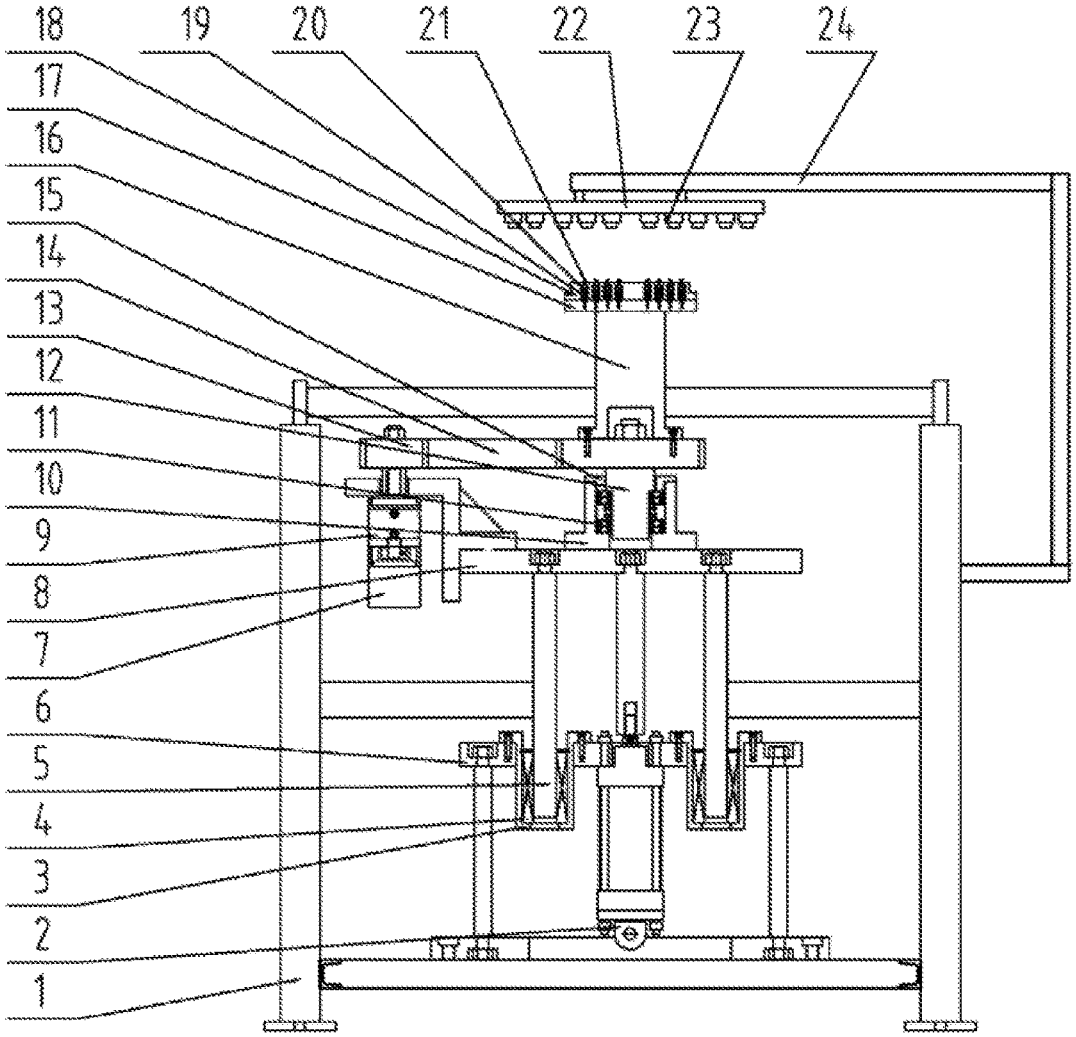
FIG. 1 is a structural diagram of a blank water blowing device provided by the present invention.
Figure 2:
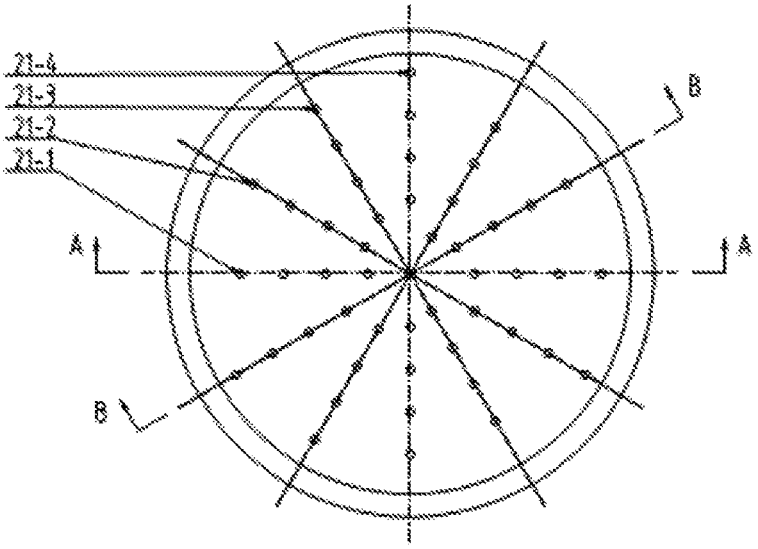
FIG. 2 is a structural diagram of a location part of a blank water blowing device provided by the present invention.
Figure 3:
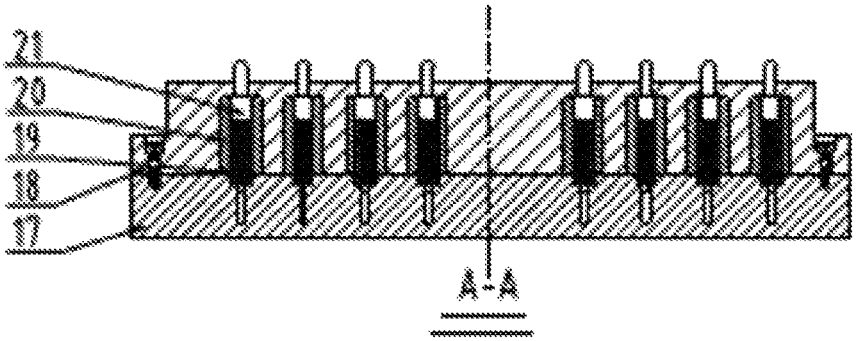
FIG. 3 is an A-A structural diagram of a location part of a blank water blowing device provided by the present invention.
Figure 4:
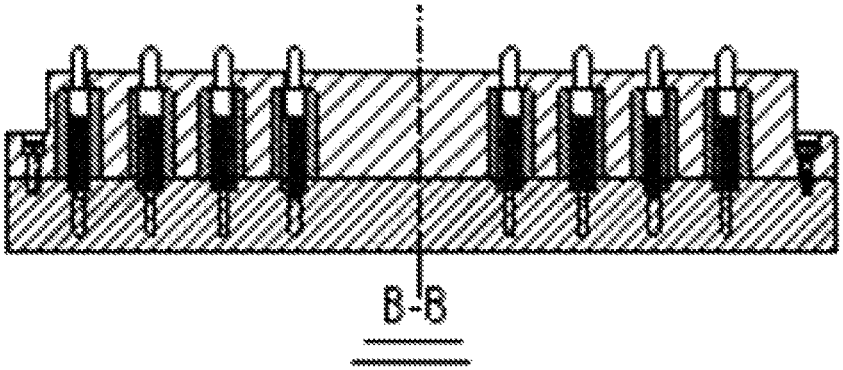
FIG. 4 is a B-B structural diagram of a location part of a blank water blowing device provided by the present invention.
Figure 5:
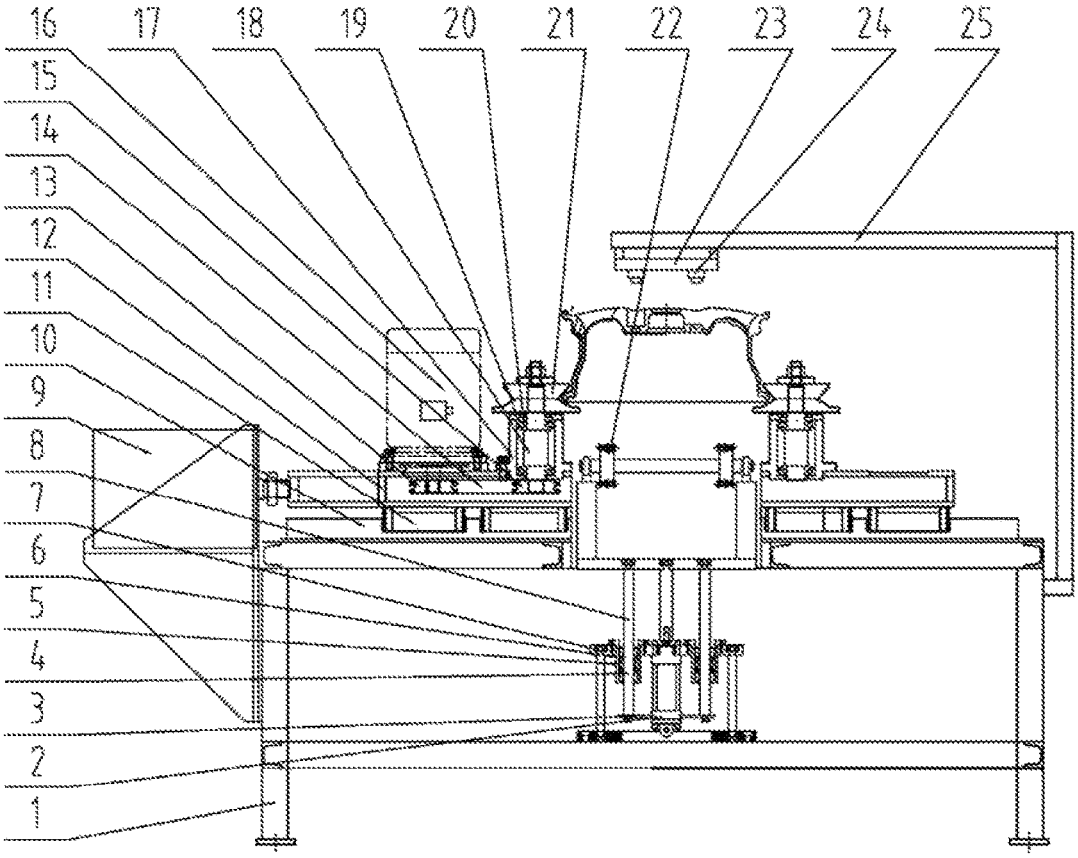
FIG. 5 is a structural diagram of a blank water blowing device provided by the present invention during working.

In the figure, numeric symbols are as follows: 1-frame, 2-lift cylinder, 3-bearing seat A, 4-linear bearing, 5-guide shaft, 6-guide shaft, 7-servomotor, 8-lifting frame, 9-speed reducer, 10-bearing seat B, 11-bearing, 12-rotating shaft, 13-synchronuous pulley A, 14-synchronuous belt, 15-gland, 16-base, 17-base plate, 18-flange, 19-spring, 20-copper sleeve, 21-floating column, 22-air supply pipe, 23-air amplifier, and 24-mounting rack.

DETAILED DESCRIPTION OF THE INVENTION

In the following, the details and working conditions of a specific device provided by the present invention are described in combination with figures.

The present invention provides a blank water blowing device. The blank water blowing device is composed of a frame 1, a lift cylinder 2, bearing seats A 3, linear bearings 4, guide shafts 5, a support 6, a servomotor 7, a lifting frame 8, a speed reducer 9, a bearing seat B 10, a bearing 11, a rotating shaft 12, a synchronous pulley A 13, a synchronous belt 14, a gland 15, a base 16, a base plate 17, a flange 18, springs 19, copper sleeves 20, floating columns 21, an air supply pipe 22, air amplifiers 23 and a mounting rack 24. The support 6 and the mounting rack 24 are fixed on the frame 1, the air amplifiers 23 are mounted on the mounting rack 24 through the air supply pipe 22, the lift cylinder 2 and the bearing seats A 3 are fixed on the support 6, the guide shafts 5 are mounted in the bearing seats A 3 through the bearing seats A 3, the top ends of four guide shafts 5 are fixed on the lifting frame 8, the servomotor 7, the speed reducer 9 and the bearing seat B 10 are mounted on the lifting frame 8, an output shaft of the speed reducer 9 is connected with the synchronous pulley A 13, the rotating shaft 12 is mounted on the bearing seat B 10 through the bearing 11 and the gland 15, the synchronous pulley is arranged at the upper end of the rotating shaft 12, the upper end of the rotating shaft 12 is connected with the synchronous pulley A 13 through the synchronous belt 14, and the base plate 17 is fixed above the rotating shaft 12 through the base 16. The springs 19, the copper sleeves 20 and the floating columns 21 are sealed in the base plate 17 and the flange 18, the copper sleeves 20 are mounted on the flange 18, two ends of each spring are respectively connected with the base plate 17 and a plane of a large-diameter lower end of the middle part of the corresponding floating column 21, and the floating columns 21 can float up and down under the action of an external force and the springs 19.

Four groups of adjacent floating columns 21-1, 21-2, 21-3, 21-4 are distributed on the flange 18 in a radiating manner, each group comprises four floating columns distributed in 120 degrees, and the radial pitch diameters of the four groups of corresponding floating columns 21 are arithmetic sequence.

During actual use, a blank is conveyed to a position of the blank water blowing device through conveyor chains; compressed air is supplied; the lift cylinder 2 drives the flange 18 to lift up through the linear bearings 4 and the guide shafts 5, and the flange 18 comes into contact with a flange face of a wheel; under the action of the gravity of the wheel, the floating columns 21 in contact with the flange face of the wheel descend, and a group of floating columns 21 in contact with the side wall of the flange face clamp the wheel in a descending process in order to prevent the wheel from radially moving, so that high-precision location of the blank is implemented. The servomotor 7 starts working to drive the flange 18 and the wheel to rotate, next, the air supply pipe 22 supplies the compressed air, the compressed air passes through the air amplifiers 23 to form high-pressure air flows, and the high-pressure air flows blow off residual water on the blank. So far, the blank water blowing operation is completed.

The invention claimed is:

1. A blank on-line water blowing device, comprising:

a frame, a lift cylinder, bearing seats A, linear bearings, guide shafts, a support, a servomotor, a lifting frame, a speed reducer, a bearing seat B, a bearing, a rotating shaft, a synchronous pulley A, a synchronous belt, a gland, a base, a base plate, a flange, springs, copper sleeves, floating columns, an air supply pipe, air amplifiers and a mounting rack;

wherein the support and the mounting rack are fixed on the frame, the air amplifiers are mounted on the mounting rack through the air supply pipe, the lift cylinder and the bearing seats A are fixed on the support, the guide shafts are mounted in the bearing seats A through the bearing seats A, top ends of four guide shafts are fixed on the lifting frame, the servomotor, the speed reducer and the bearing seat B are mounted on the lifting frame, an output shaft of the speed reducer is connected with the synchronous pulley A, the rotating shaft is mounted on the bearing seat B through the bearing and the gland, the synchronous pulley is arranged at an upper end of the rotating shaft, the rotating shaft is connected with the synchronous pulley A through the synchronous belt, and the base plate is fixed above the rotating shaft through the base.

2. The blank on-line water blowing device according to claim 1, wherein the springs, the copper sleeves and the floating columns are sealed in the base plate and the flange, the copper sleeves are mounted on the flange, two ends of each spring are respectively connected with the base plate and a plane of a lower end of the middle part of the corresponding floating column, and the floating columns can float up and down under an action of an external force and the springs.

3. The blank on-line water blowing device according to claim 1, wherein four groups of adjacent floating columns are distributed on the flange in a radiating manner, each group comprises four floating columns distributed in 120 degrees, and radial pitch diameters of the four groups of corresponding floating columns are arithmetic sequence.

* * * * *